US011324300B2

(12) United States Patent
Enrique et al.

(10) Patent No.: US 11,324,300 B2
(45) Date of Patent: May 10, 2022

(54) COMBING DEVICE

(71) Applicants: Asin Terol Enrique, Madrid (ES); Fernando Ivan Bermudez, Madrid (ES)

(72) Inventors: Asin Terol Enrique, Madrid (ES); Fernando Ivan Bermudez, Madrid (ES)

(73) Assignee: CAPILLUS MARKETING LLC, Miami, FL (US)

( * ) Notice: Subject to any disclaimer, the term of this patent is extended or adjusted under 35 U.S.C. 154(b) by 0 days.

(21) Appl. No.: 16/899,057

(22) Filed: Jun. 11, 2020

(65) Prior Publication Data

US 2020/0297095 A1 Sep. 24, 2020

Related U.S. Application Data

(63) Continuation-in-part of application No. 15/533,465, filed on Jun. 6, 2017, now abandoned.

(51) Int. Cl.

| | |
|---|---|
| ***A45D 24/22*** | (2006.01) |
| ***A45D 24/00*** | (2006.01) |
| ***A45D 24/10*** | (2006.01) |

(52) U.S. Cl.

CPC ..... *A45D 24/22* (2013.01); *A45D 24/10* (2013.01); *A45D 2024/002* (2013.01); *A45D 2200/207* (2013.01)

(58) Field of Classification Search

CPC ..... A45D 24/007; A45D 24/22; A45D 24/24; A45D 2019/025; A45D 19/02; A46B 15/0016; A46B 15/0018; A46B 15/002; A46B 15/0022; A46B 15/0024; A46B 15/0026; A46B 15/0028; A46B 15/003; A46B 15/0032; A46B 15/0034; A46B 15/0036; A46B 11/00; A46B 11/0013

USPC ..... 132/112, 113, 114, 115, 116, 119.1, 148; 119/602, 603, 605, 612, 615, 652, 664, 119/600; D30/158; 401/291, 287, 4; 15/1.52

See application file for complete search history.

(56) References Cited

U.S. PATENT DOCUMENTS 2,737,190 A * 3/1956 Magnusson ..... A45D 24/24 132/114
4,121,602 A * 10/1978 Young ..... A45D 24/22 132/113

(Continued)

FOREIGN PATENT DOCUMENTS

| | | | | |
|---|---|---|---|---|
| CN | 109363324 A * | 2/2019 | | |
| DE | 102004057737 A1 * | 3/2006 | ..... | A46B 11/0079 |
| WO | WO-2009015802 A1 * | 2/2009 | ..... | A46B 15/0002 |

OTHER PUBLICATIONS

AlphaLab, Inc, "The Triboelectric Series", 2018 (Year: 2018).*

*Primary Examiner* — Tatiana L Nobrega
*Assistant Examiner* — Sarah Woodhouse
(74) *Attorney, Agent, or Firm* — Melvin K. Silverman

(57) ABSTRACT

A handheld device for combing and dispensing a non-liquid cosmetic on human hair, the device comprising a main body with a container portion for housing a dispersible dry cosmetic content, an attached handle portion, an internal shaking means, and brushing zone on the bottom of said container portion, wherein the brushing zone comprises a plurality of protruding teeth configured to produce a triboelectric effect to help the dry cosmetic adhere to a user's hair.

14 Claims, 11 Drawing Sheets

(56) References Cited

U.S. PATENT DOCUMENTS

| | | | | |
|---|---|---|---|---|
| 4,213,423 | A * | 7/1980 | Bryan | A01K 13/003 119/605 |
| 4,610,925 | A * | 9/1986 | Bond | A46D 1/00 15/1.52 |
| 5,150,491 | A * | 9/1992 | Ikemoto | A46B 9/023 132/219 |
| 7,311,456 | B1 * | 12/2007 | Neal | A46B 11/0003 401/179 |
| 10,271,627 | B1 * | 4/2019 | Calvo | A46B 11/001 |
| 2005/0183736 | A1 * | 8/2005 | Wang | A45D 19/02 132/119.1 |
| 2008/0056802 | A1 * | 3/2008 | Baghdoian | A46B 11/0013 401/45 |
| 2008/0149124 | A1 * | 6/2008 | McKay | A61P 37/00 132/116 |
| 2011/0089268 | A1 * | 4/2011 | Isaacs | A45D 19/00 239/690 |
| 2011/0206445 | A1 * | 8/2011 | Hurwitz | A46B 11/0096 401/282 |
| 2017/0318953 | A1 * | 11/2017 | Park | A46B 11/0079 |
| 2018/0344020 | A1 * | 12/2018 | Sommer | A45D 24/24 |
| 2019/0261768 | A1 * | 8/2019 | Tsui | A45D 19/02 |

* cited by examiner

COMBING DEVICE

CROSS-REFERENCE TO RELATED APPLICATIONS

The application is a continuation-in-part of co-pending application Ser. No. 15/533,465, filed Jun. 6, 2017. All prior related patents and patent applications are herein incorporated by reference in their entirety.

TECHNICAL FIELD OF THE INVENTION

The present invention belongs to the field of distributing cosmetics, more particularly, to the field of distributing cosmetics in the hair.

BACKGROUND OF THE INVENTION

Many ways of applying hair products have been already disclosed in the state of art. The most common one is applying the product on the user's hand and then applying the product on the hair with their hand. Another way used in the cosmetic application is by means of a spray, which pulverizes the cosmetic product in the hair.

The problem found in these solutions is that the product is not uniformly distributed, the product does not reach hair and scalp uniformly and part of the product is wasted because the user does not know with accuracy the amount of product that should be used in each application, and does not have a way of reaching the hair and scalp directly.

SUMMARY OF THE INVENTION

The present invention discloses a handheld device for combing and dispensing a non-liquid cosmetic on human hair, the device comprising a main body with a container portion, an attached handle portion, an internal shaking means, and brushing zone on the bottom of said container portion, wherein the brushing zone comprises a plurality of protruding teeth.

The container portion includes a lower opening on the brush zone side of the container, an internal removable cartridge, and an inner chamber configured for receiving said removable cartridge. The removable cartridge is slidably removable upon guiding geometrical elements of an interior of said container and a front opening of complementary geometrical shape to that of said removable cartridge allowing a substantially tight engagement.

Further disclosed, is the removable cartridge defining a reservoir for housing a dry non-liquid content, wherein said removable cartridge includes a plurality of apertures on a lower side for allowing said dry non-liquid content to leave said removable cartridge when the device is engaged. These apertures of said removable cartridge align with said lower opening of said container portion to allow said dry non-liquid contents to leave said container portion when the device is engaged.

Yet further disclosed are dispenser doors positioned at said lower opening of said container, wherein said dispenser doors are configured to move from a closed position to an open position upon engagement of the device, thereby allowing dry non-liquid content to flow out.

Yet further disclosed in the invention is at least a portion of said plurality of protruding teeth of said brushing zone are configured to produce a triboelectric effect.

It is an object of this invention to provide a handheld device for applying dry cosmetic to one's hair in a way that provides maximum efficiency in dispensing said cosmetic in a user's hair.

It is a further object of this invention to provide a handheld device that uses a triboelectric effect to statically charge the hair to allow keratin fibers to cling more thoroughly providing a fuller appearance of one's hair.

It is additionally an object of this invention to provide a refillable handheld combing device adapted to be incorporated into a user's daily grooming routine.

It is yet further an object of this invention to provide a system that reduces mess and spills caused by loose dry cosmetics.

The above and other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
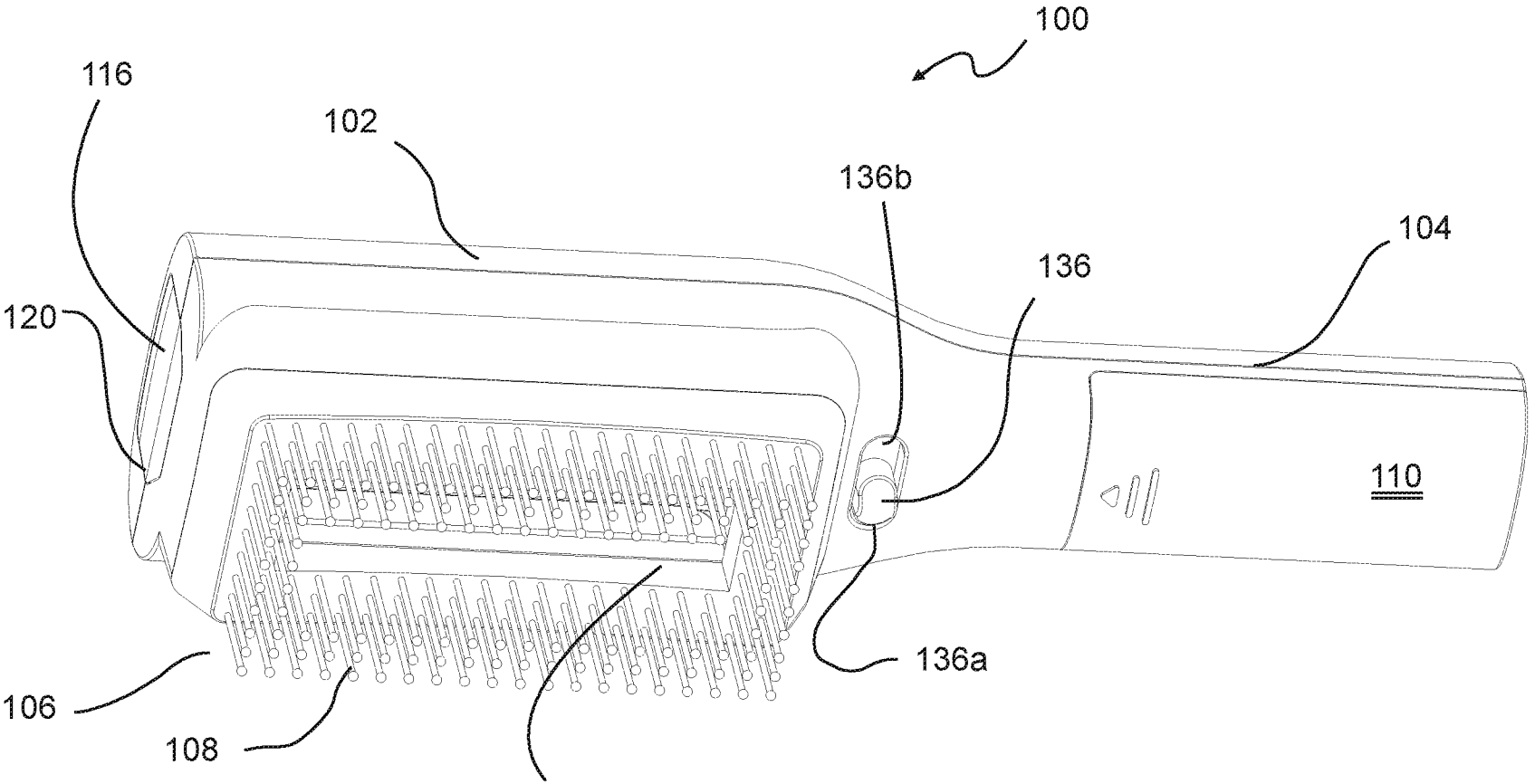
FIG. 1 is a perspective view of the handheld device.
Figure 2:
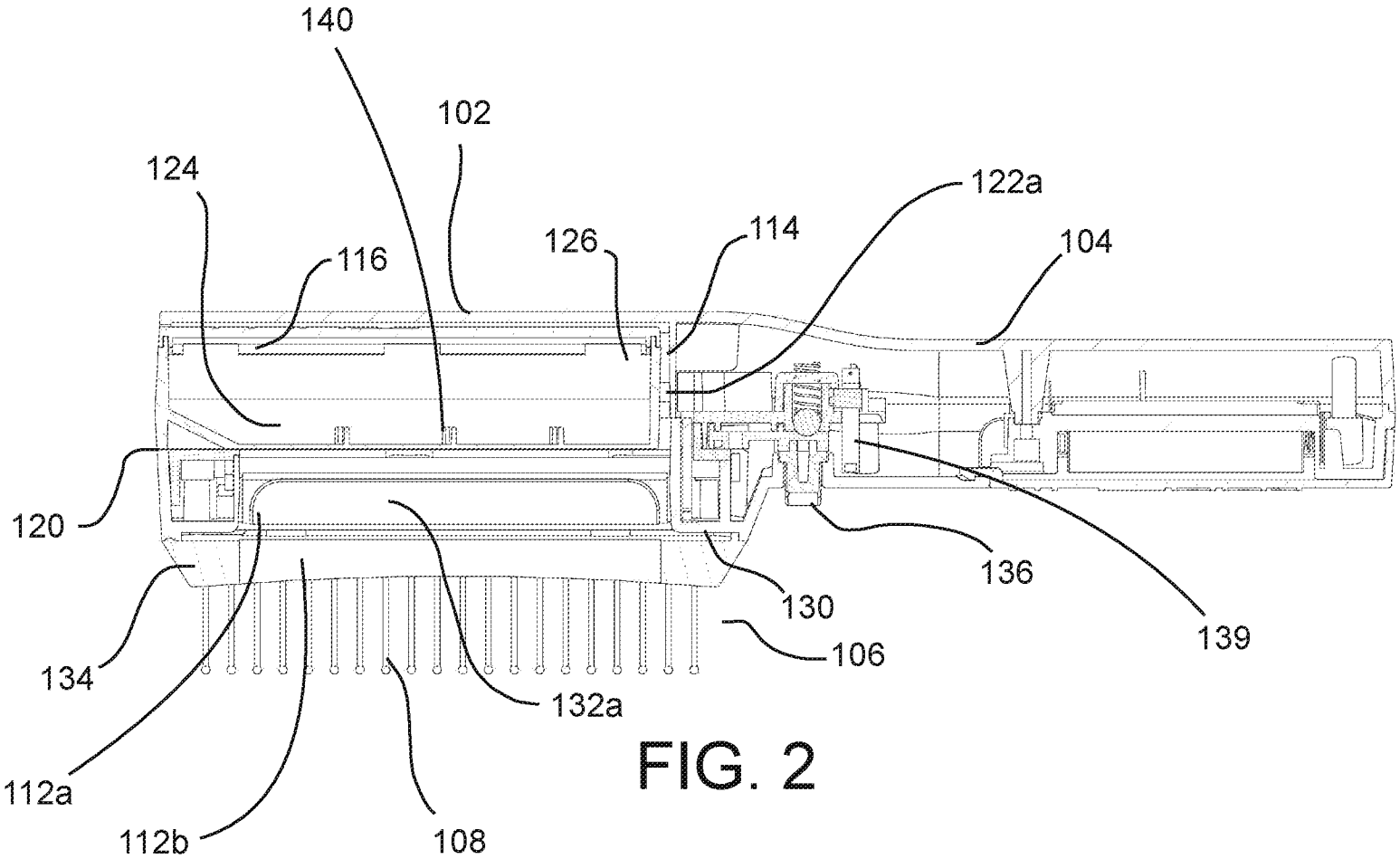
FIG. 2 is a cross-sectional view of the handheld device showing the orientation of the internal components.

The brush system disclosed herein provides instant temporary coverage of thinning hair. It is quick in its application, easy to use, curtails mess, and evenly distributes for effective coverage. The brush system is a handheld device 100 that uses thousands of miniature keratin fiber particles, which cling statically to hair, instantly concealing areas of thinning hair. The handheld device is a revolutionary tool for natural looking keratin fiber application in seconds. The handheld device can be incorporated in to a user's everyday routine. The handheld device also has components to reduce mess and prevent accidental spills. This system can be primarily seen in FIGS. 1-3 and 6-13, with FIGS. 4 and 5 providing conceptual views of embodiments with different shaking means. FIG. 1 is a perspective view of the handheld device. FIG. 2 is a cross-sectional view of the handheld device showing the orientation of the internal components.

Figure 3:
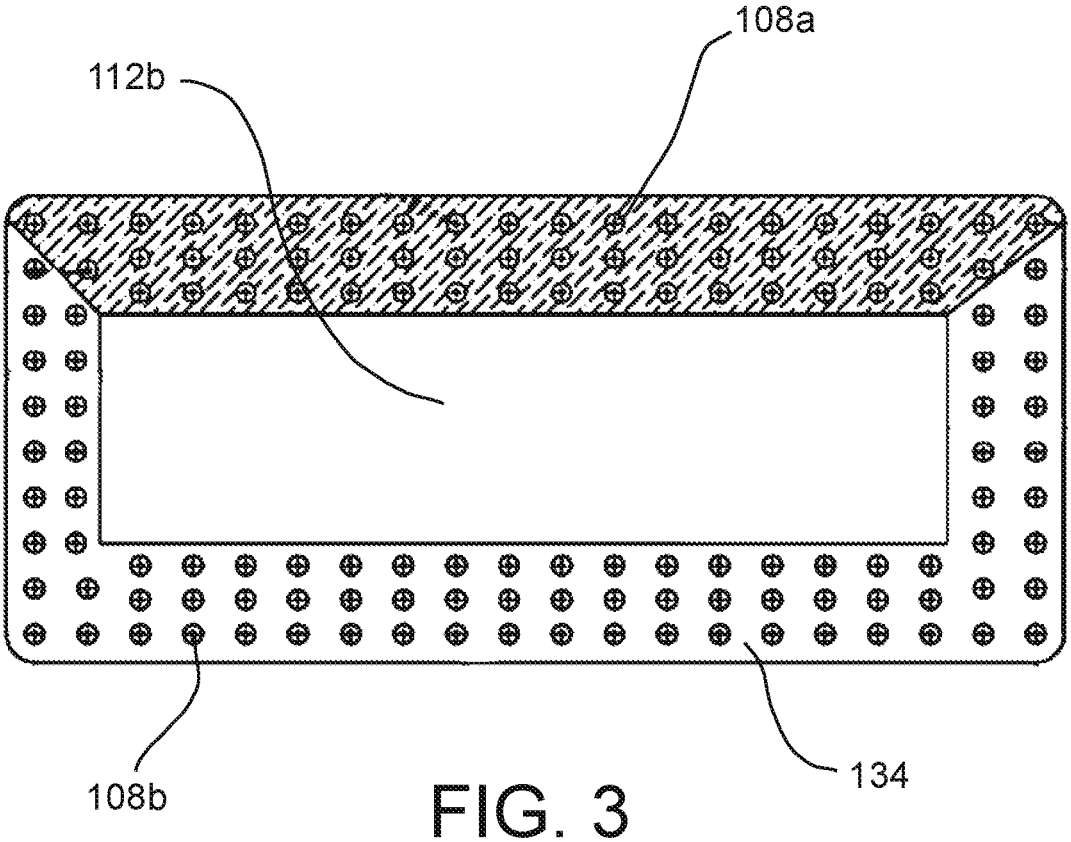
FIG. 3 is a bottom view of the removable brush plate.
Figure 4:
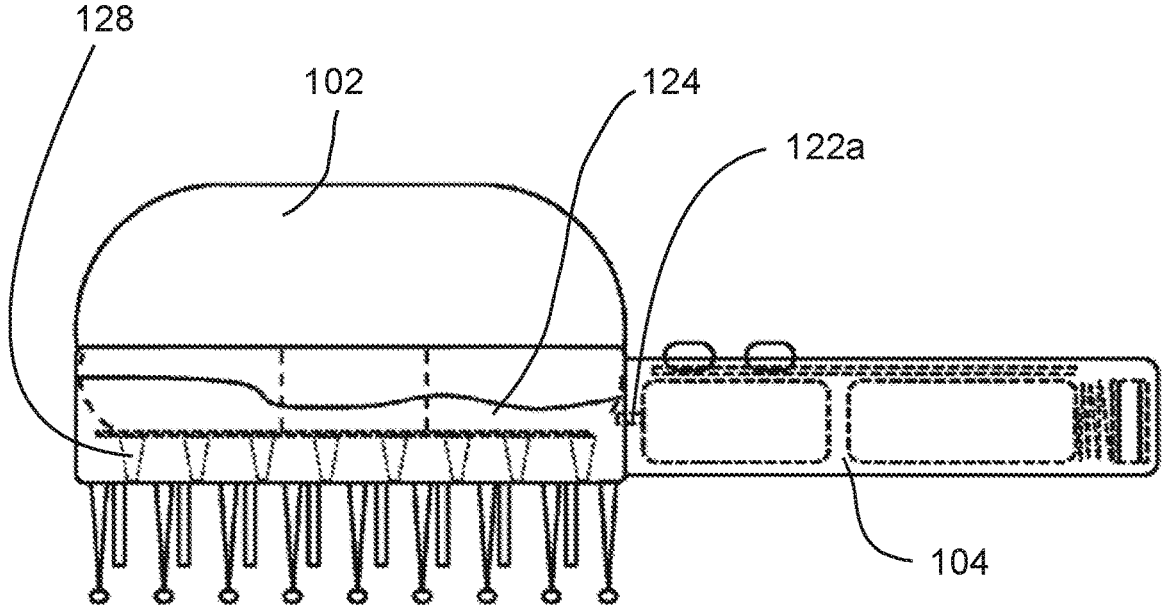
FIG. 4 is a conceptual view of a handheld device using a vibration motor as a shaking means.
Figure 5:
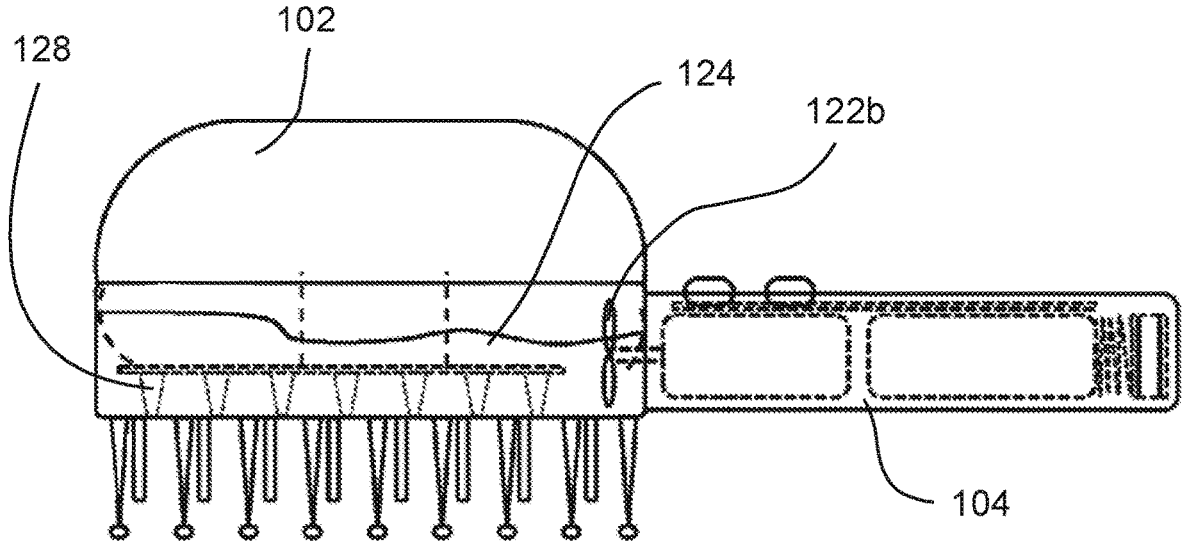
FIG. 5 is a conceptual view of a handheld device, similar to that of FIG. 4, but showing use of a fan as a shaking means.
Figure 6:
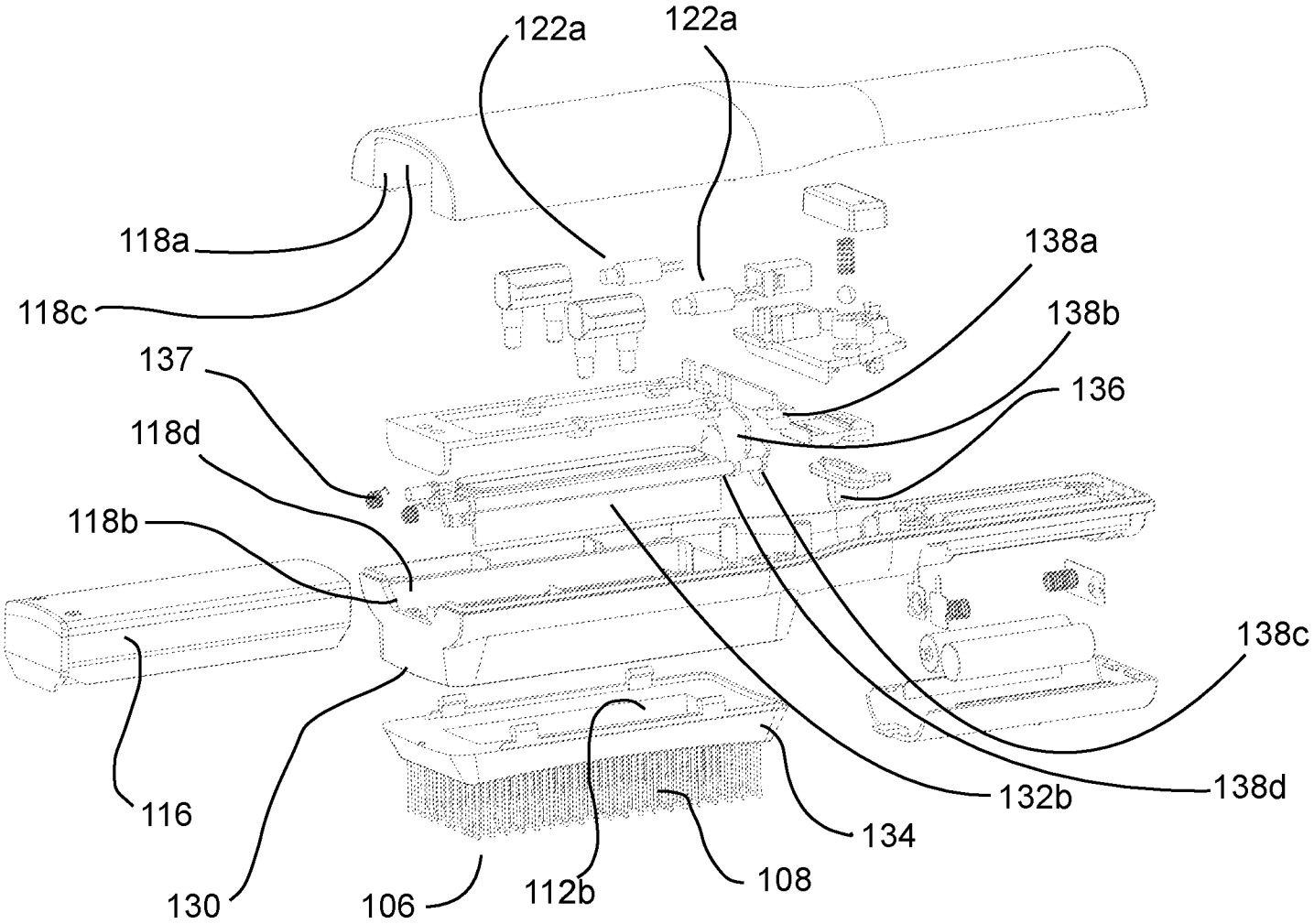
FIG. 6 is an exploded front perspective view showing the internal and external components.
Figure 7:
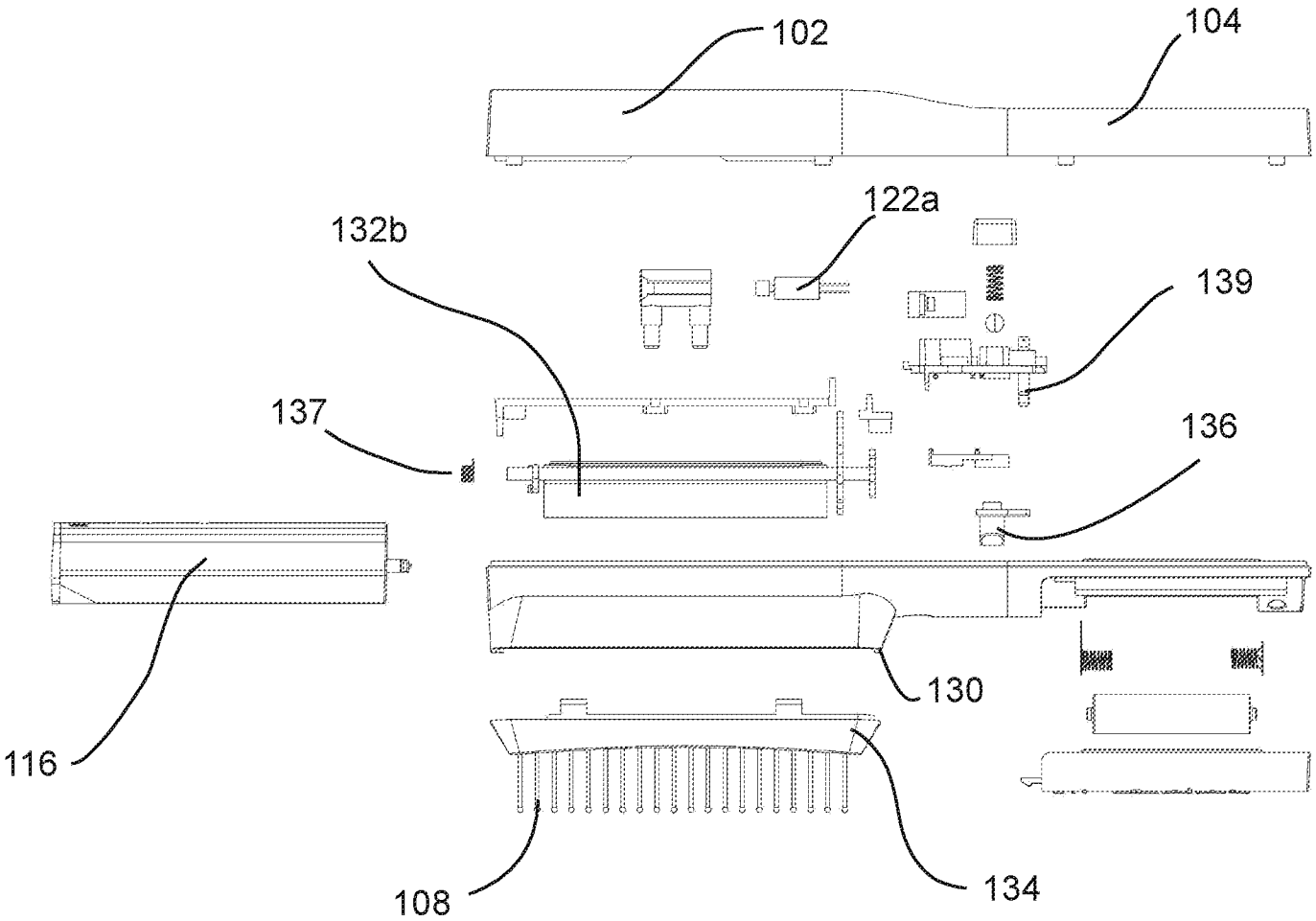
FIG. 7 is an exploded side view showing the internal and external components.
Figure 8:
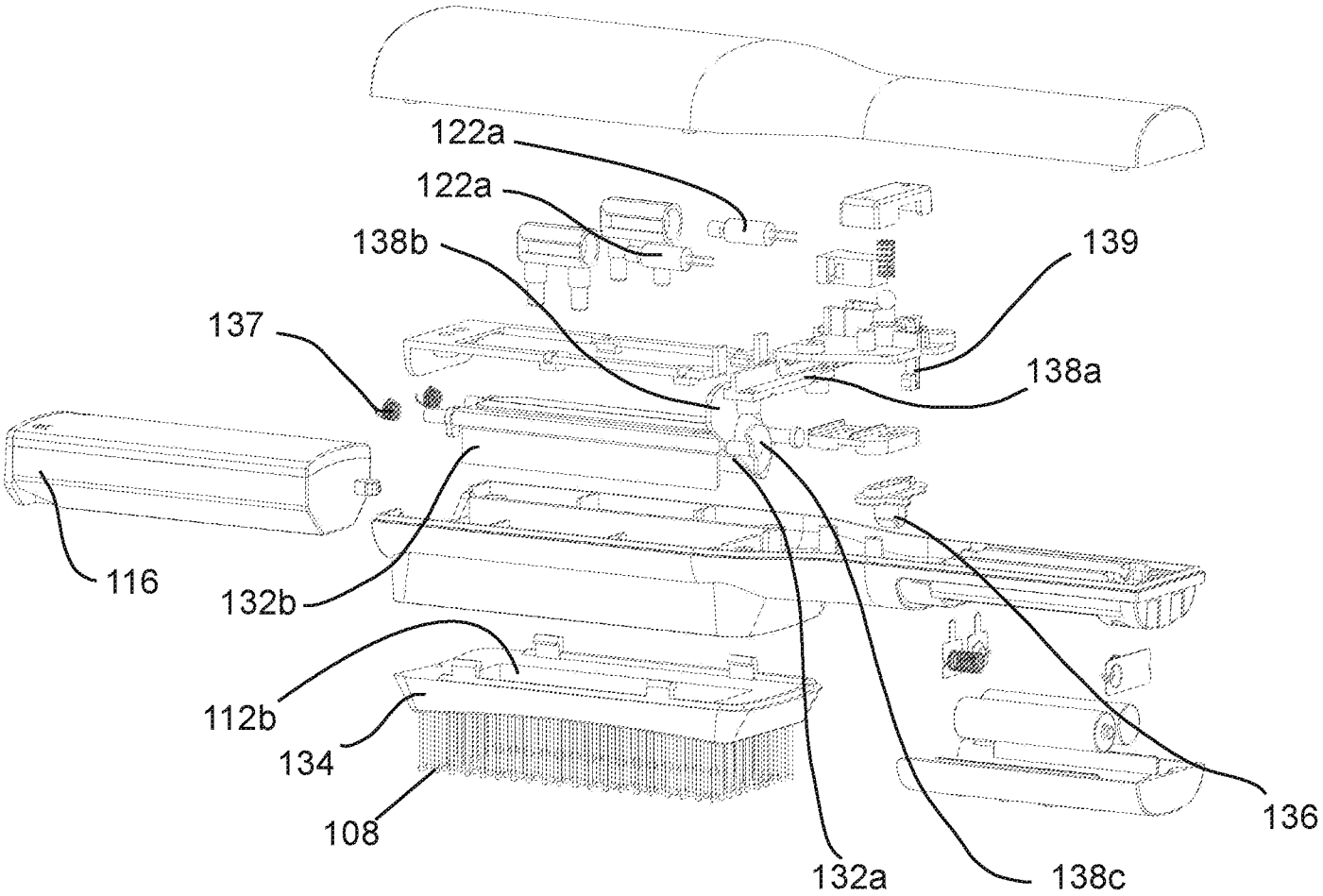
FIG. 8 is an exploded rear perspective view showing the internal and external components.
Figure 9:
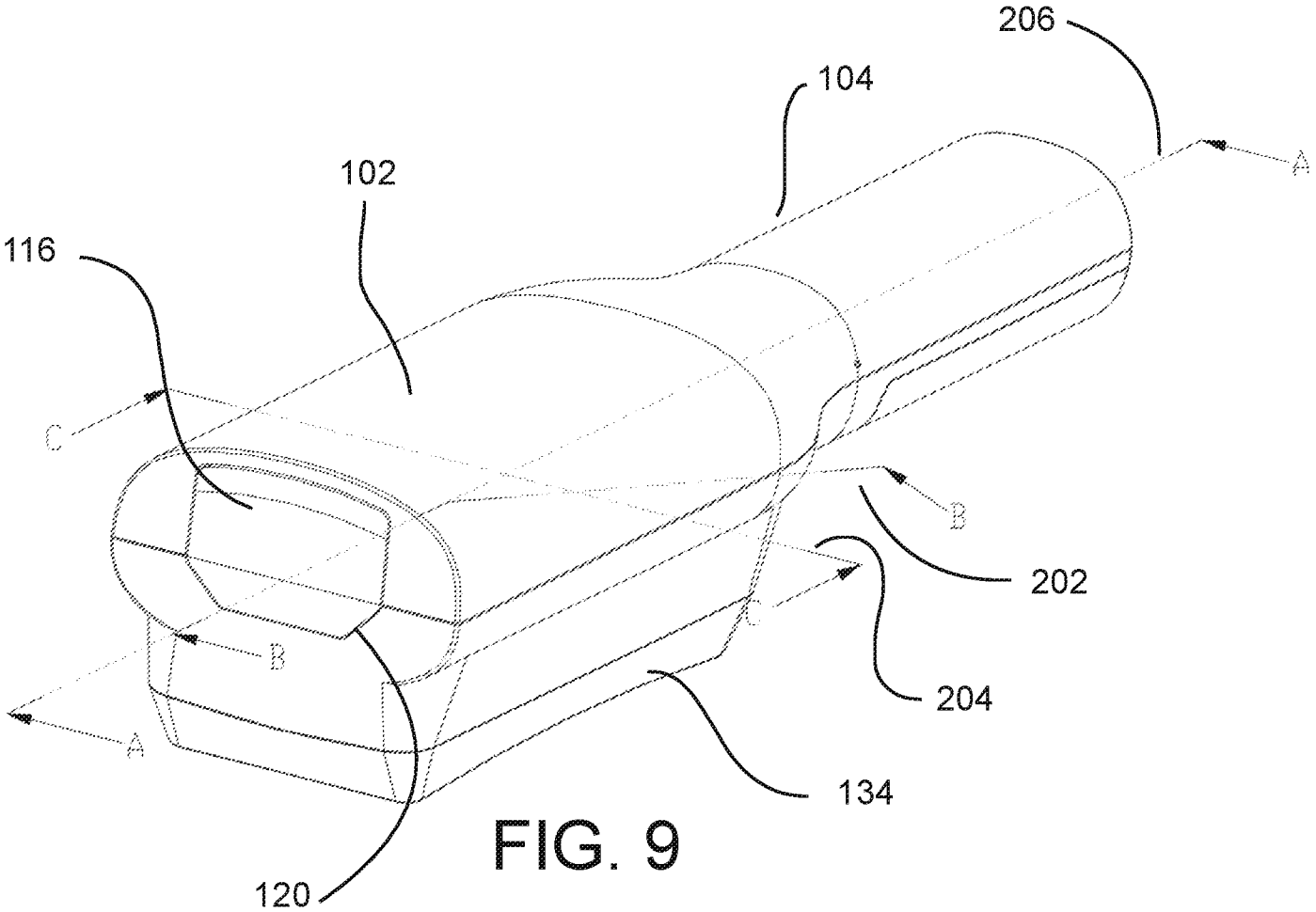
FIG. 9 is a front perspective view showing cross-sectional cuts.
Figure 10:
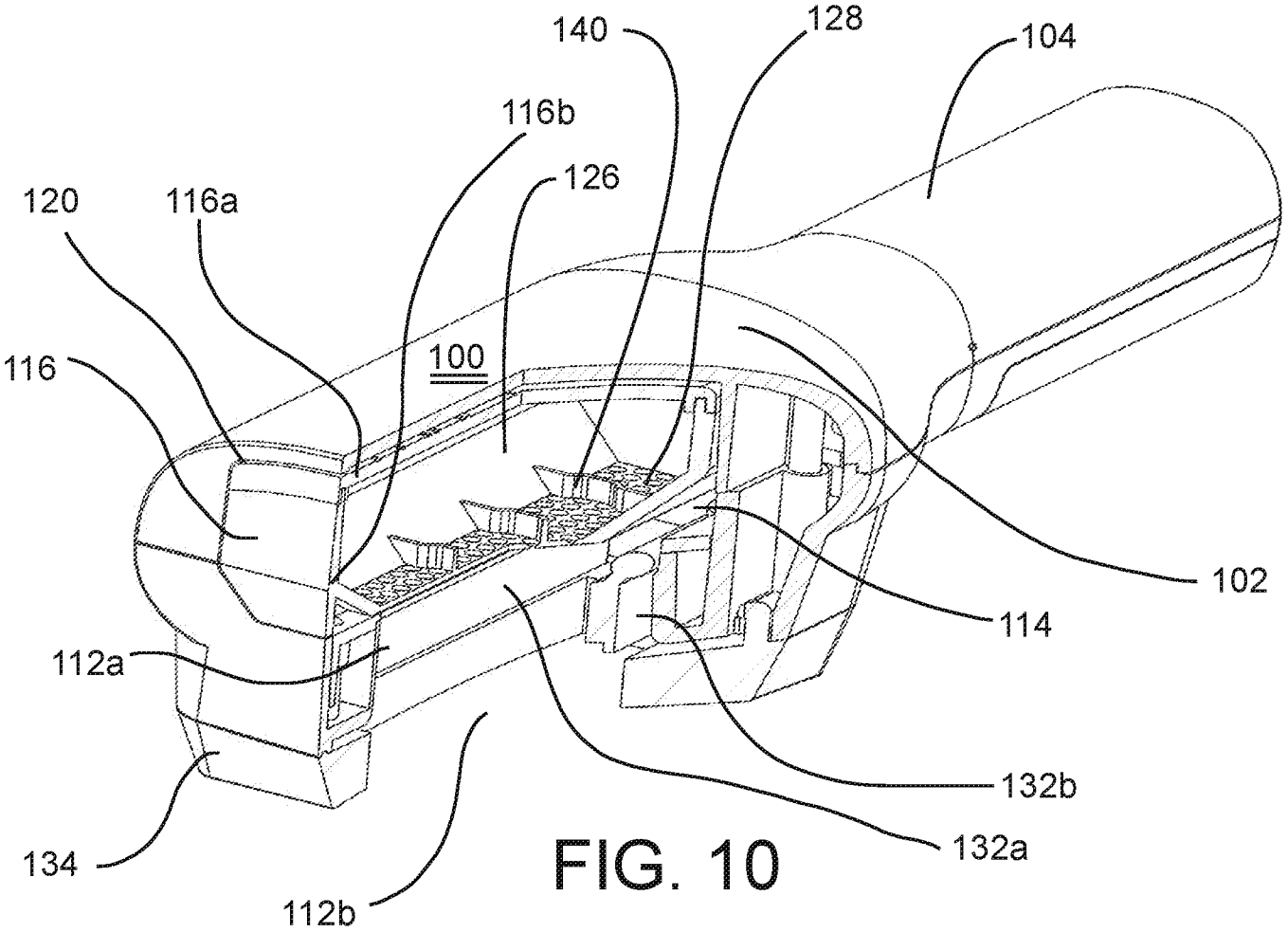
FIG. 10 is a front perspective view showing cross-sectional cut B-B.
Figure 11:
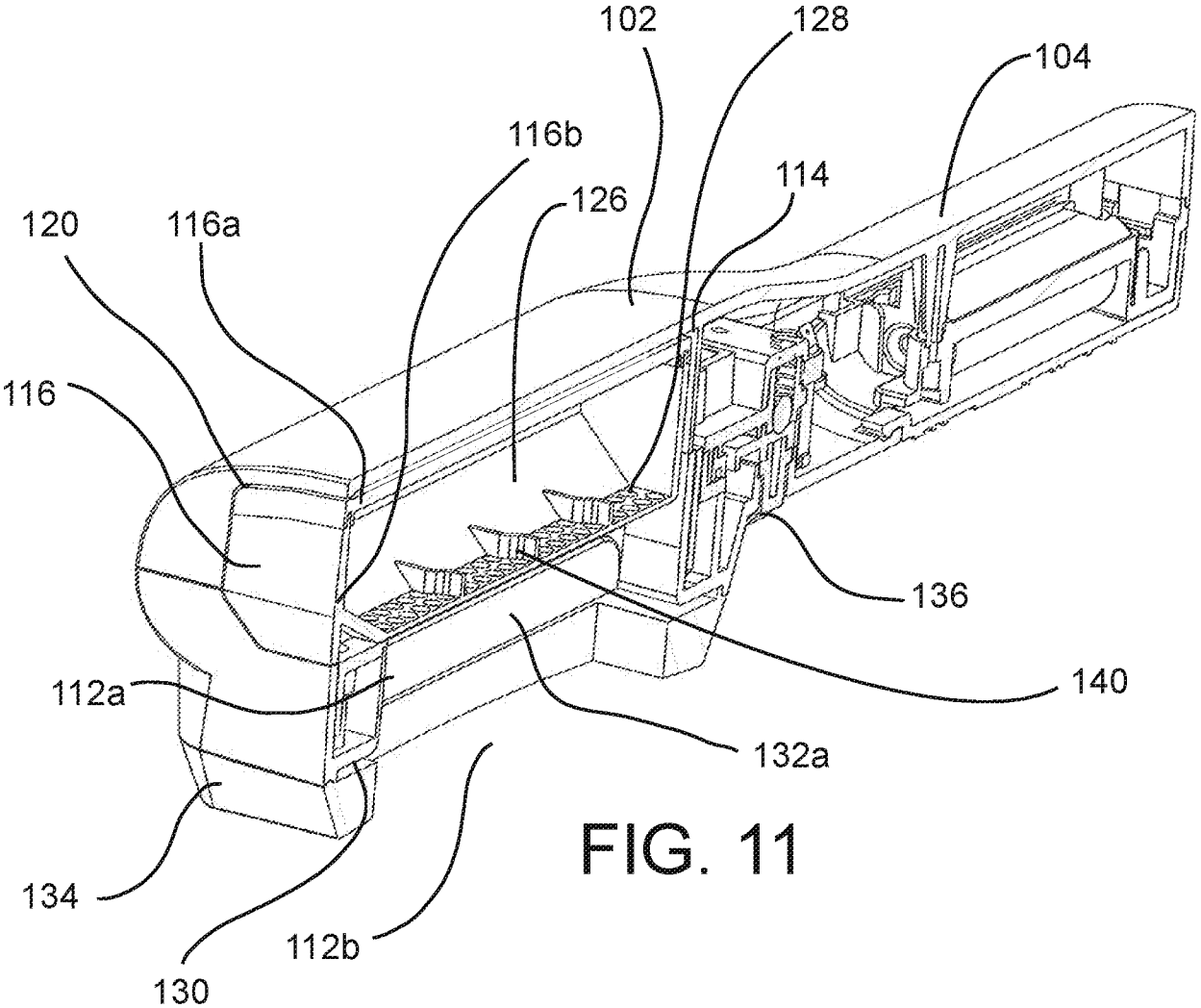
FIG. 11 is a front perspective view showing cross-sectional cut A-A.
Figure 12:
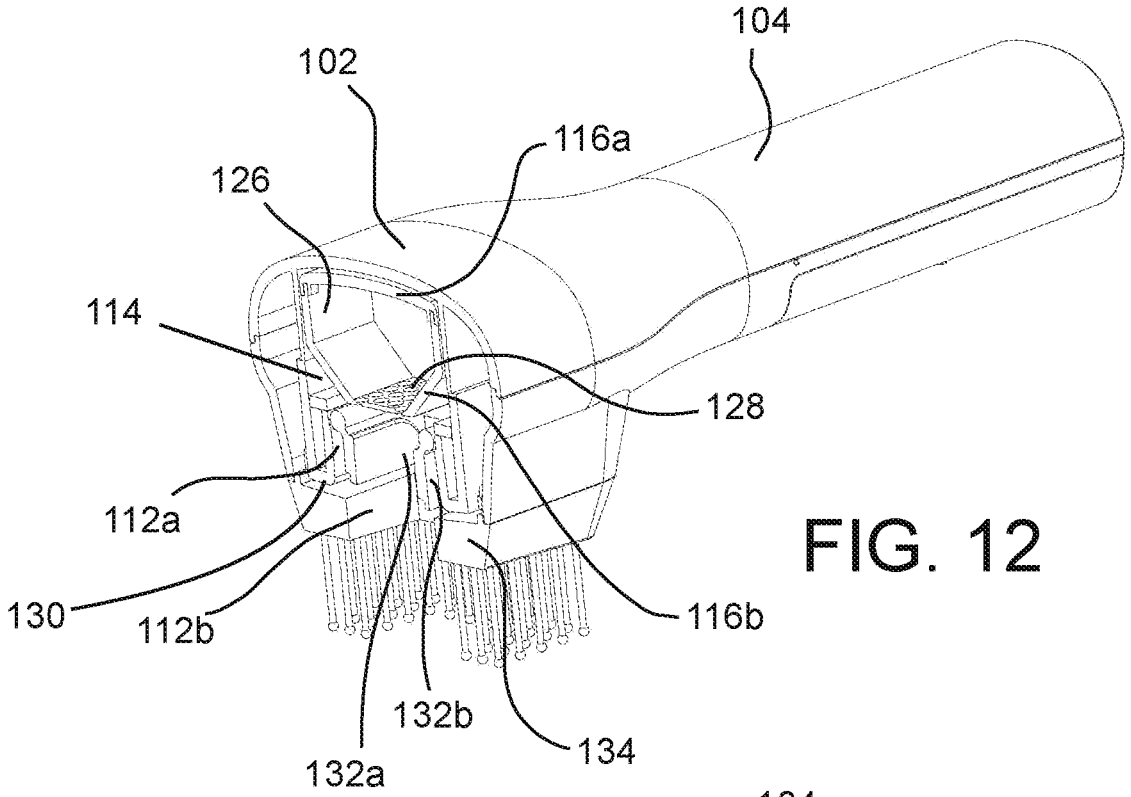
FIG. 12 is a front perspective view showing cross-sectional cut C-C with dispenser doors open.
Figure 13:
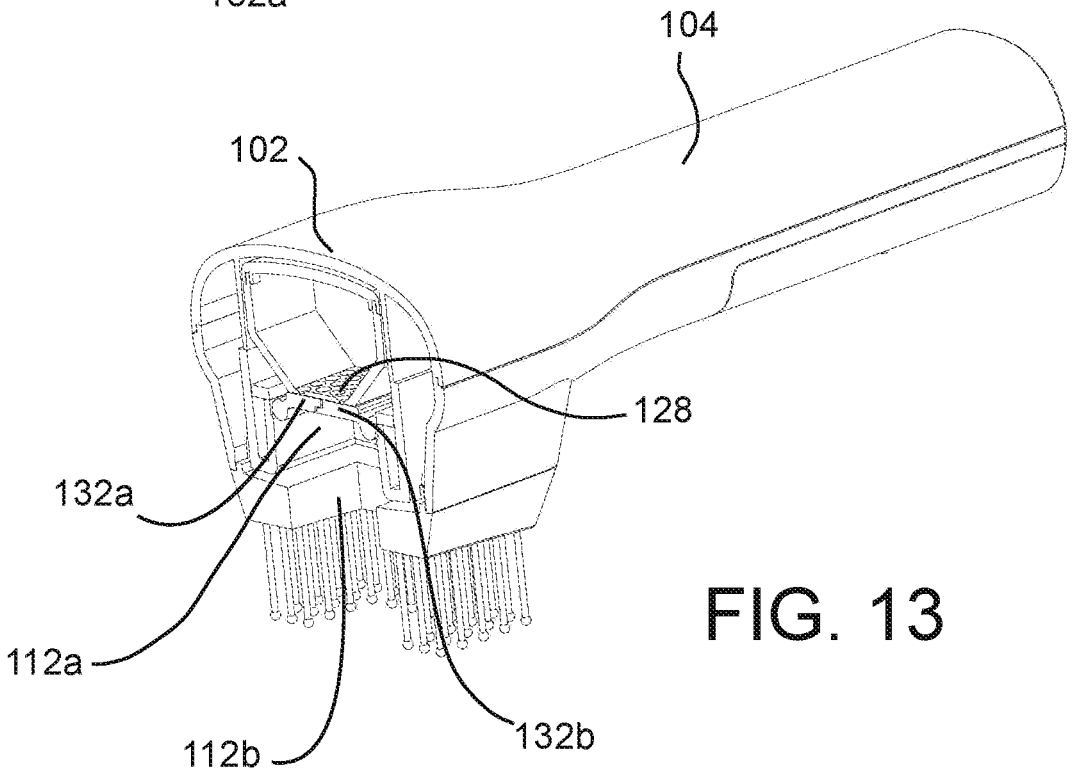
FIG. 13 is a front perspective view showing cross-sectional cut C-C, similar to FIG. 12, but showing the dispenser doors closed.

FIG. 3 is a bottom view of the removable brush plate. FIG. 4 is a conceptual view of a handheld device using a vibration motor as a shaking means. FIG. 5 is a conceptual view of a handheld device, similar to that of FIG. 4, but showing use of a fan as a shaking means. FIG. 6 is an exploded front perspective view showing the internal and external components. FIG. 7 is an exploded side view showing the internal and external components. FIG. 8 is an exploded rear perspective view showing the internal and external components. FIG. 9 is a front perspective view showing cross-sectional cuts. FIG. 10 is a front perspective view showing cross-sectional cut B-B 202. FIG. 11 is a front perspective view showing cross-sectional cut A-A 206. FIG. 12 is a front perspective view showing cross-sectional cut C-C 204 with dispenser doors 132*a*/132*b* open. FIG. 13 is a front perspective view showing cross-sectional cut C-C 204, similar to FIG. 12, but showing the dispenser doors 132*a*/132*b* closed.

As may be seen in FIGS. 1, 2, and 6-8, The handheld device 100 uses removable cartridges 116. The cartridge 116 in and of itself may be refillable, reusable, or a one-time use. Primarily, FIGS. 10 and 11 show the cartridge 116, wherein the cartridge includes a lower container portion 116*b* and an upper lid section 116*a*. Cartridges 116 will typically come with a seal over the apertures for transport to prevent keratin fibers from leaking out of the apertures 128. This seal will need to be removed prior to loading a cartridge 116 into a handheld device 100. A user loads a cartridge 116 into an inner chamber 114 of the container portion 102 by aligning the geometrical shape of the cartridge with a geometric opening 120 in the container portion, leading to the inner chamber 114 for containing the cartridge 116.

It is to be appreciated that the non-liquid content 124 contained in the cartridge 116 are dry fibers, such as keratin, or in other embodiments, dry shampoo. This is because the apertures 128 in the cartridges 116 are of a geometric shape to limit the amount of non-liquid content 124 released at any given time, to control dispersion. Because the means for releasing fibers are the use of a plurality of apertures 128 and a shaking means 122*a*/122*b*, a non-liquid must be used. Materials like liquids, syrups, and gels have a high viscosity and the vibratory means will not have the same effect on these materials. In addition, these materials tend to be sticky or stick to the brush materials due to moisture, which could render the invention unusable. Thus, it should be understood that this device is used with non-liquid content, so that this dry material can be sifted out of the apertures freely.

In addition, the goal is to brush dry hair only so an electrostatic charge is created and maintained. If humid or wet hair is brushed, or a moisture product is to be applied, then the electrostatic charge cannot be created or sustained.

The brush system also has dispenser doors 132*a*/132*b*, on the brush side 130 of the brush enclosure, to prevent accidental discharge or spills of keratin fibers when the handheld device is not in use. FIGS. 12 and 13 show the functionality of these dispenser doors. The dispenser doors 132*a*/132*b* are held closed by a spring mechanism 137, as may be seen in FIGS. 6-8, wherein the set of spring 137 forces the dispenser doors 132*a*/132*b* to snap shut if not engaged. A user may open the dispenser doors 132*a*/132*b* by moving an engagement switch 136 to a second position from a first position. In this embodiment, the engagement switch is a power switch, and in its primary embodiment, may be a contact switch, shown in FIGS. 2, 7, and 8 with contact switch element 139. The first position 136*b* of the engagement switch 136 is an off position 136*b*, and the second position 136*a* is an open position 136*a*. When the engagement switch is slid from the off position 136*b* to the open position 136*a*, the internal portion of the engagement switch pushes against opening mechanism of the dispenser doors, which mechanically opens the doors. This opening mechanism is comprised of structural members 138*a*, 138*b*, 138*c*, and 138*d*.

Moving the engagement switch, to a third position from a second position, the unit engages a battery-powered shaking means 122*a*/122*b*. In some embodiments, the second position is the open position, and the third position is the on position. The shaking means is typically at least one vibration motor 122*a*. The vibrations of the motor 122*a* against the components of the handheld device 100 move the dry non-liquid content 124, likely dry keratin fibers, over a series of apertures 128 which allow the keratin fibers to fall on to a user's hair. At least a portion of a plurality of protruding teeth 108 creates a triboelectric effect with the user's hair, electrostatically charging the hair. The keratin fibers will be electrostatically attracted to the user's hair, thereby sticking to the hair. By electrostatically charging the hair rather than the keratin fibers, the brush system removes issues that prior inventions have had, where said prior inventions attempt to charge the keratin fibers wherein the statically charged fibers clump up and stick among themselves.

Depending on a user's hair requirements, the brush zone 106 may be interchangeable with different removable brush plates 134. That is, the teeth of the brush 108 are connected at their base to a detachable surface 134, wherein a user can pop off the teeth from the handheld combing device 100 and reattach another set. This is important because the brush zone 106 may employ use of teeth, such as soft bristles capable of significant flex in that they are hair-like bristles, or they may be more stiff, as typical plastic or PVC bristles are. Further, the teeth may generate the triboelectric themselves, or separate protrusions that generate the triboelectric effect may be used. These separate teeth may be similar in look, but different in antistatic functionality. This could be primarily useful when the teeth materials themselves are of a material incapable of creating a triboelectric effect.

Although the teeth 108 are not distinguished by shape or color, their chemical composition differs by the fact that the teeth in the front 108*a* of the combing area may not contain anti-static agent whereas the teeth in the sides and the back part of the combing area 108*b* do have anti-static agent. This can be seen primarily in FIG. 3. This design is meant to be used with the right hand, however, because the brush plate 134 is detachable, other orientations may be attached, or rotated. After the fiber is applied there should be minimized contact with teeth that maintain a high electrostatic charge for the fibers to remain adhered to the hair shaft as opposed to the teeth. For that reason, teeth in the sides and back part 108*b* contain a chemical antistatic agent, or antistatic elements.

The triboelectric generating teeth 108*a* may also be located surrounding the brushing zone 106 of the handheld combing device 100, so that the triboelectric effect is induced regardless the direction of the combing action, and before the teeth 108 of the combing device make contact with the hair.

The invention provides a combing device for combing hair 100, the device comprising a container suitable for housing some content 102, the container comprising apertures 128 arranged in a brushing zone 106 of the container, a plurality of teeth 108 attached to the brushing zone of the container, shaking means 122*a*/122*b*, suitable for causing a movement in the interior of the container, and a triboelectric generator 108*a* adapted for creating a triboelectric effect on the hair to be combed, characterized in that the container further comprises a covering structure, such as dispenser doors 132*a*/132*b*, movable between a first position and a second position, and further adapted to cover the apertures 128 of the container 102, when the covering structure, such as the dispenser doors 132*a*/132*b*, is in a first position, and uncover the holes 102 of the container, when the covering structure, such as dispenser doors 132*a*/132*b*, is in a second position.

Further stated, the invention is a handheld device 100 for combing and dispensing a non-liquid cosmetic on human hair. The device has a main body 110 with a container portion 102, an attached handle portion 104, and brushing zone 106 on the bottom of the container portion. The brushing zone has a plurality of protruding teeth 108. The container portion includes a lower opening 112*a* on the brush zone side of the container, includes an internal removable cartridge 116, includes an inner chamber configured for receiving the removable cartridge 114, wherein the removable cartridge is slidably removable upon guiding geometrical elements (side walls 118*c*/118*d*, top semi-circular opening 118*a*, and bottom semi-circular opening 118*b*) of an interior of the container 102 and a front opening of complementary geometrical shape 120 to that of the removable cartridge 116 allowing a substantially tight engagement. Here, substantially tight means that the cartridge 116 is allowed to move slightly so that it shakes when engaged to allow the internal powdered contents 124 to escape more easily, but the cartridge 116 is not so loose that it rattles around in the interior chamber 114 of the container portion 102. Also included is an internal shaking means 122*a*/122*b*, which can be at least one vibration motor 122*a* or at least one fan 122*b*, which affects a forcing of an airflow inside the container.

The removable cartridge 116 defines a reservoir 126 for housing a dry non-liquid content 124. This reservoir may also have internal divisional sections 140 to improve deployment of the dry non-liquid content when the brush is tilted thereby helping promote consistency. The removable cartridge also includes a plurality of apertures 128 on a lower side for allowing the dry non-liquid content to leave the removable cartridge when the device is engaged. These apertures 128 of the removable cartridge 116 align with the lower opening 112*a* of the container portion 102 to allow the dry non-liquid contents to leave the container portion when the device is engaged. This removable cartridge 116 may also be refillable in some embodiments. In most embodiments, the removable cartridge 116 contains only dry keratin fibers. This apertures can be primarily seen in FIGS. 10 and 11, and the cartridge can be seen in FIGS. 2, 10, and 11.

The in some embodiments, the diameters of the apertures 128 are between a range of 0.3 mm and 3 mm, and in other embodiments, the apertures 128 are between a range of 1.0 mm and 1.5 mm. The diameter most suitable for keratin fibers is between 1.0 mm and 1.5 mm. Dry shampoos work best with apertures 128 with a diameter from 0.6 mm through 1 mm. These apertures 128 may also be tapered to facilitate dispersion of the dry content more easily.

Dispenser doors 132*a*/132*b* are positioned at the lower opening 112*a* of the container portion. The dispenser doors 132*a*/132*b* are configured to move from a closed position to an open position upon engagement of the device. This allows dry non-liquid content to flow out.

At least a portion of the plurality of protruding teeth 108 of the brushing zone are configured to produce a triboelectric effect. These triboelectric generating teeth 108*a* do not contain any antistatic elements. Another portion of the protruding teeth may contain antistatic elements. These antistatic elements are defined as antistatic agents employed to remove the static effect from the teeth. These antistatic elements may be an antistatic coating over the teeth material, or antistatic elements incorporated into the material itself. For example, antistatic an antistatic agent incorporated into the nylon. In some embodiments, this portion of protruding teeth of the brush zone containing an antistatic coating 108*b* are configured to one side of the brushing zone so that one side of the brushing zone produces a triboelectric effect and the remaining side does not produce a triboelectric effect.

The plurality of protruding teeth 108 is semi-flexible yet stiff material, or may be of a soft material capable of significant flex, such as a fibrous material. When the plurality of protruding teeth 108 is made of a softer material capable of significant flex, as described above, additional protrusions may also be included that are separate stiff protrusions capable of producing a triboelectric effect 108*a*. In further embodiments, the plurality of protruding teeth 108 is a combination of semi-flexible stiff and soft material.

The brush zone is further defined as a removable plate 134 capable of attaching and detaching from the brush zone side 130 of the container portion 102, wherein the plurality of protruding teeth 108 of the brushing zone 106 are attached to the removable plate 134. In many embodiments, the removable plate is configured based on an orientation of triboelectric effect capable teeth. An lower opening 112*b* in the center of the brush plate 134 also exists, which aligns with the upper opening 112*a* in the container portion 102 of the main body 110, to allow the dry non-liquid content 124 to escape from the apertures 128 unimpeded.

The handheld device further includes an engagement switch 136 having at least two positions, including a first position 136*b* and a second position 136*a*. The first position 136*b* is an off position 136*b*, wherein the shaking means 122*a*/122*b* of the handheld device remains unengaged (turned off), and the dispenser doors 132*a*/132*b* remain closed when the switch is in this position. The second position 136*a* is a fully engaged (on) position 136*a* in which, when the switch 136 is moved to the second position 136*a*, the handheld device is fully engaged, resulting in the dispenser doors 132*a*/132*b* being forced into an open position and the shaking means engaged and shaking the container portion of the handheld device. The open and closed positions of the dispenser doors 132*a*/132*b* can be primarily seen in FIGS. 12 and 13 respectively.

Forcing of the dispenser doors 132*a*/132*b* closed is accomplished by a set of springs 137 connected to both the container portion 102 and the dispenser doors 132*a*/132*b* which urge the doors close. Opening of the dispenser doors 132*a*/132*b* is accomplished by way of a set of movable structural members 138*a*, 138*b*, 138*c*, and 138*d*, positioned complementary to the switch mechanism 136 so that when the switch mechanism 136 is placed in the second position 136*a*, the body of the switch mechanism pushes against a structural member engaging other structural members to thereby push the doors open against the force of the spring.

In some embodiments, the activation/deactivation of the shaking means 122*a*/122*b* is synchronized with the opening/closing of the dispenser doors 132*a*/132*b* so that when the shaking means are activated, the dispenser doors are moved to the open position and when the shaking means are deactivated, the dispenser doors are released to the closed position. Stated another way, some embodiments of the handheld combing device 100 require a user to push the on/off engagement switch 136 from an off position 136*b* to a mid-position, which just opens the dispenser doors 132*a*/

132*b*. Then a user will push the switch from the mid-position to an on position 136*a*, thereby turning the shaking means 122*a*/122*b* on, helping the content spread in the hair. Other embodiments simply have an on and an off position 136*b* so what when the device is turned on, the doors open 132*a*/132*b* at the same time that the shaking means 122*a*/122*b* begins vibrating the contents 124 out of the apertures 128.

The handheld combing device 100 is adapted to spread the content of the container 124 to the scalp and the hair. The content of the container leaves the container through the apertures 128 and the content 124 is laid along the hair and the scalp.

Advantageously, the handheld combing device 100 allows a user to comb himself and to distribute the dry non-liquid content 124 of the removable cartridge 116 in the container portion 102, equally in each region of his hair. This equal distribution allows for reduction in amount of content 124 used, prolonging the amount of time between refills and reducing wasted content. The handheld combing device 100 of the invention allows correct administration of the treatment along the hair and the scalp. Furthermore, the triboelectric effect prepares the hair for a better reception of the content 124 of the container.

When the covering structure, in the form of dispenser doors 132*a*/132*b*, is in its first (closed) position, it covers the apertures 128 and as a consequence, the content of the container 124 cannot exit the container portion 102. When the covering structure is in its second (open) position, the apertures 128 are uncovered and the content 124 of the container can exit the container portion through the apertures 128. Advantageously, the covering structure, such as dispenser doors 132*a*/132*b*, allows spreading the content of the container only when desired by the user, thus saving the content of the container from being wasted. Different configurations are also possible.

The triboelectric generating teeth 108*a* achieves its aim by using a material with an electron affinity lower than the electron affinity of hair, which is deemed to be around +45 nC/J. In this scale, wool is considered to be the reference value (0 nC/J). Because of that, a material with an electron affinity between +40 nC/J and −190 nC/J is suitable. Electron affinity, or charge affinity, is considered as the charge transfer per unit of energy that is transferred when two bodies are rubbed against the other. Thus, any material with such an electron affinity will create a triboelectric effect in hair.

The material in the triboelectric generating protrusions 108*a* may comprise a polymer with an electron affinity which is comprised between −40 nC/J and −190 nC/J. This polymer could be a vinyl polymer such as PVC.

A polymer, such as a plastic, may be chosen as a material, because of its electron affinity, which is higher than the average for human hair.

In some embodiments, the triboelectric generating protrusions 108*a* are comprised in the teeth themselves, if they are made of such a polymer.

The triboelectric generating teeth 108*a* generate a triboelectric effect in the hair to be combed. This effect prepares the hair to receive the content 124 of the container, as it separates each hair from the others while contributing to adhere the material within the container to the hair due to differences in electrostatic charge.

When using the handheld device 100, a user will first brush his or her hair to electrostatically charge the hair without opening the dispenser doors 132*a*/132*b*, thereby retaining the fibers and leaving them undeployed in this step. Once the hair is charged, the user will then brush the hair area a second time, opening the dispenser doors 132*a*/132*b*, thereby deploying the keratin fiber 124 over the hair in need for density increase through use of electrostatically clinging keratin fibers. This is repeated until the desired effect is achieved.

In some embodiments, the triboelectric generating protrusions 108*a* are located surrounding the brushing zone 106 of the handheld combing device 100. This configuration provides the advantage that the triboelectric effect is induced in the hair regardless the direction of the combing action.

The triboelectric generating protrusions 108*a* may comprise a vinyl polymer such as PVC, with an electron affinity around −100 nC/J. This triboelectric generating protrusion 108*a* is capable to cause a triboelectric effect on the hair when the teeth 108 of the handheld combing device 100 make contact with the hair. In this particular embodiment, the triboelectric generating protrusions 108*a* comprise PVC elements, which are arranged in the brushing zone 106, next to the teeth 108.

The shaking means 122*a*/122*b* may be synchronized with the covering structure, such as dispenser doors 132*a*/132*b*, so that when shaking means are activated, the covering structure is moved to the second position (open) and when shaking means are deactivated, the covering structure is released to the first position (closed). Stated another way, when the shaking means 122*a*/122*b* is turned on, the covering structure, which may be dispenser doors 132*a*/132*b*, will be in an open position, and when the shaking means is disengaged, the dispenser doors 132*a*/132*b* will close.

The container may further include a spring, or pair of springs 137, attached to the covering structure, such as dispenser doors 132*a*/132*b*, and to the container portion 102, wherein the springs are arranged to force the covering structure, such as dispenser doors 132*a*/132*b*, to be in its first (closed) position. In this embodiment, the shaking means 122*a*/122*b* are configured to engage in syncronization with the opening of the covering structure, such as dispenser doors 132*a*/132*b*, to the second position when they are activated, by applying a force which overcome the force produced by the springs 137. When the user deactivates the shaking means 122*a*/122*b*, the engagement switch 136 releases its force, and the springs 137 move the covering structure, such as dispenser doors 132*a*/132*b*, back to the first position, thus covering the apertures 128.

The diameters of the apertures 128 in a particular embodiment of the container are between 0.3 mm and 3 mm. This size of the apertures allows the content 124 inside the cartridge 116 to disberse without blocking the apertures 128. In a more particular embodiment, the diameters of the apertures 128 of the cartridge 116 are between 1.0 mm and 1.5 mm. Diameters between 1.0 mm and 1.5 mm are especially suitable when the content 124 comprises keratin fibers.

In some embodiments, the apertures 128 are tapered, to ease dispersion of their content 124. In these embodiments, the apertures 128 are tapered, i.e., they are provided in a funnel shape, so that the hole is wider inside the cartridge 116 and is narrower outside the cartridge 116.

In most embodiments, the shaking means comprise a vibration motor 122*a* which causes the container portion 102 to vibrate. Advantageously, these vibrations avoid the obstruction of the apertures 116 if the content is solidified or irregular. This vibration motor 122*a* is placed next to the cartridge 116, and when it is activated, it causes the cartridge 116 and container portion 102 to vibrate. When the content 124 is inside the cartridge 116, the shaking means 122*a* prevent the content from being stuck in the apertures 128, causing the content to exit uniformly by the apertures 128.

The shaking means 122*a*/122*b* are adapted for causing the content of the container to move, avoiding the content from being stuck in the apertures of the container, and letting the content to leave the container in a more uniform way. Advantageously, this solves the problem that arises when the action of gravity alone during the combing is not effective enough to distribute the content of the container uniformly, for example when combing the sides of the head. This is also useful when the content of the container is very compact and there is need to shake the container to move the content so that it is uniformly distributed along the hair.

In different embodiments, the shaking means comprise means for causing an airflow inside the container, such as a fan 122*b*. As a consequence, the content of the container is stirred by the airflow. When the fan 122*b* is activated, the fan causes the content inside the container to move by the airflow generated by the fan, thus preventing the content 124 from being stuck in the apertures, causing the content to exit uniformly by the apertures 128.

While there has been shown and described above the preferred embodiment of the instant invention it is to be appreciated that the invention may be embodied otherwise than is herein specifically shown and described and that, within the invention, certain changes may be made in the form and arrangement of the parts without departing from the underlying ideas or principles of this invention as set forth in the Claims appended herewith. As such, all the features described in this specification (including the claims, description and drawings) and/or all the steps of the described invention can be combined in any combination, with the exception of combinations of such mutually exclusive features and/or steps.

We claim:

1. A handheld device for combing and dispensing a non-liquid cosmetic on human hair, the device comprising:

a main body comprising a container portion having first and second opposing sides extending between proximal and distal ends, a plurality of protruding teeth disposed on the first side and defining a brushing zone, the brushing zone comprising a four-sided lower opening, and a handle portion extending from the proximal end;

an engagement switch movable between a fully engaged position and an off position;

an internal shaking means configured to apply a vibration to the container portion;

a removable cartridge defining a reservoir therein for housing a dry non-liquid content, the cartridge comprising a bottom wall having a plurality of apertures therethrough to dispense the dry non-liquid content from the reservoir when the shaking means vibrates the container and the removable cartridge therein;

the container portion further comprising an inner chamber having an opening at the distal end of the container portion for receiving the removable cartridge, wherein the removable cartridge is slidably engaged with the container portion via guiding geometrical elements of the inner chamber of complemental geometrical shape to that of the removable cartridge establishing contacting engagement therebetween;

first and second dispenser doors positioned at the four-sided lower opening and directly below the bottom wall of the cartridge, each of the dispenser doors having a first side coupled to a corresponding side of the container portion and a second side opposite the first side, wherein the first and second dispenser doors are configured to rotate from a closed position where the second sides are engaged with one another, to an open position where the second sides are spaced apart from each other upon placing the engagement switch in the fully engaged position, thereby allowing dry non-liquid content to flow out of the reservoir through the plurality of apertures and onto the user's hair;

the plurality of protruding teeth are arranged in a four-sided configuration surrounding the four-sided lower opening, wherein a first side in the four-sided arrangement includes a first subset of the plurality of protruding teeth, the first subset is constructed of a material having an electron affinity between a range of +40 nC/J and −190 nC/J to produce a triboelectric effect, and a remaining three sides in the four-sided arrangement includes a second subset of the plurality of protruding teeth, wherein the second subset of protruding teeth include an antistatic coating, whereby the first side in the four-sided arrangement produces a triboelectric effect and the remaining three sides do not produce a triboelectric effect allowing a user to evenly distribute the non-liquid contents through the user's hair by running the plurality of protruding teeth through the user's hair with the first side contacting the user's hair first creating a static charge on the user's hair to attract the non-liquid content, and the remaining three antistatic sides contacting the user's hair after the first side, whereby the non-liquid contents do not adhere to the remaining three sides of the plurality of protruding teeth, allowing the non-liquid content to evenly stay on a user's hair.

2. A handheld device for combing and dispensing a non-liquid cosmetic on human hair, the device comprising:

a main body comprising a container portion having first and second opposing sides extending between proximal and distal ends, a plurality of protruding teeth disposed on the first side and defining a brushing zone, the brushing zone comprising a four-sided lower opening, and a handle portion extending from the proximal end;

an engagement switch movable between a fully engaged position and an off position;

an internal shaking means configured to apply a vibration to the container portion;

a removable cartridge defining a reservoir therein for housing a dry non-liquid content, the cartridge comprising a bottom wall having a plurality of apertures therethrough, and a plurality of partition walls on an interior of the cartridge and extending transversely along the bottom wall to evenly distribute the dry non-liquid content through the reservoir for dispensing through the plurality of apertures when the shaking means vibrates the container and the removable cartridge therein;

the container portion further comprising an inner chamber having an opening at the distal end of the container portion for receiving the removable cartridge, wherein the removable cartridge is slidably engaged with the container portion via guiding geometrical elements of the inner chamber of complemental geometrical shape to that of the removable cartridge establishing contacting engagement therebetween;

first and second dispenser doors positioned at the four-sided lower opening and directly below the bottom wall of the cartridge, each of the dispenser doors having a first side coupled to a corresponding side of the container portion and a second side opposite the first side, wherein the first and second dispenser doors are configured to rotate from a closed position where the second sides are engaged with one another, to an open position where the second sides are spaced apart from each other upon placing the engagement switch in the fully engaged position, thereby allowing dry non-liquid content to flow out of the reservoir through the plurality of apertures and onto the user's hair;

the plurality of protruding teeth are arranged in a four-sided configuration surrounding the four-sided lower opening, wherein a first side in the four-sided arrangement includes a first subset of the plurality of protruding teeth, the first subset is constructed of a material having an electron affinity between a range of +40 nC/J and −190 nC/J to produce a triboelectric effect, and a remaining three sides in the four-sided arrangement includes a second subset of the plurality of protruding teeth, wherein the second subset of protruding teeth include an antistatic coating, whereby the first side in the four-sided arrangement produces a triboelectric effect and the remaining three sides do not produce a triboelectric effect allowing a user to evenly distribute the non-liquid contents through the user's hair by running the plurality of protruding teeth through the user's hair with the first side contacting the user's hair first creating a static charge on the user's hair to attract the non-liquid content, and the remaining three anti-static sides contacting the user's hair after the first side, whereby the non-liquid contents do not adhere to the remaining three sides of the plurality of protruding teeth, allowing the non-liquid content to evenly stay on a user's hair.

3. The handheld device as recited in claim 2, wherein said removable cartridge contains only dry keratin fibers.

4. The handheld device as recited in claim 2, wherein the material of the first subset of the plurality of protruding teeth is a polymer.

5. The handheld device as recited in claim 2, wherein the brushing zone is a removable plate capable of attaching and detaching from said the container portion, wherein the plurality of protruding teeth of the brushing zone are attached to the removable plate.

6. The handheld device as recited in claim 2, wherein the shaking means of the handheld device is deactivated and the dispenser doors remain closed when the engagement switch is in the off position; and when the engagement switch is in the fully engaged position, the first and second dispenser doors are forced into an open position and the shaking means is activated, shaking the container portion of the handheld device.

7. The handheld device as recited in claim 6, wherein the first and second dispenser doors are forced closed by a set of springs connected to both the container portion and the dispenser doors which urge the dispenser doors closed, and opening of the first and second dispenser doors is accomplished by way of structural members positioned complemental to the engagement switch such that when the engagement switch is placed in the fully engaged position, the engagement switch pushes against the structural member, thereby pushing the dispenser doors open against the force of the spring.

8. The handheld device as recited in claim 6, wherein the shaking means are synchronized with the dispenser doors so that when the shaking means are activated, the dispenser doors are moved to the open position and when the shaking means are deactivated, the dispenser doors are released to the closed position.

9. The handheld device as recited in claim 2 which the diameters of the apertures are between a range of 0.3 mm and 3 mm.

10. The handheld device as recited in claim 2 which the diameters of the apertures are between a range of 1.0 mm and 1.5 mm.

11. The handheld device as recited in claim 2 in which said apertures are tapered.

12. The handheld device as recited in claim 2 in which the shaking means is at least one vibratory motor which affects a vibratory motion within said container.

13. The handheld device as recited in claim 2 which the shaking means is at least one fan that affects a forcing of an airflow inside said container.

14. The combing device as recited in claim 2 in which said removable cartridge is refillable.

* * * * *